US006408734B1

(12) United States Patent
Cohen

(10) Patent No.: US 6,408,734 B1
(45) Date of Patent: Jun. 25, 2002

(54) COMPOSITE ARMOR PANEL

(76) Inventor: Michael Cohen, Kibbutz Kfar Etzion, Mobile Post, North Yehuda 90200 (IL)

( * ) Notice: Subject to any disclaimer, the term of this patent is extended or adjusted under 35 U.S.C. 154(b) by 0 days.

(21) Appl. No.: 09/673,013

(22) PCT Filed: Mar. 4, 1999

(86) PCT No.: PCT/IL99/00126

§ 371 (c)(1),
(2), (4) Date: Oct. 6, 2000

(87) PCT Pub. No.: WO99/53260

PCT Pub. Date: Oct. 21, 1999

(30) Foreign Application Priority Data

Apr. 14, 1998 (IL) ..... 124085

(51) Int. Cl.[7] ..... F41H 5/02
(52) U.S. Cl. ..... 89/36.02
(58) Field of Search ..... 89/36.05, 36.01; 428/911

(56) References Cited

U.S. PATENT DOCUMENTS

| | | | | | |
|---|---|---|---|---|---|
| 1,463,498 | A | * | 7/1923 | Burgess | 109/81 |
| 2,768,919 | A | * | 10/1956 | Bjorksten et al. | 428/51 |
| 3,523,057 | A | * | 8/1970 | Buck | 428/156 |
| 3,705,558 | A | * | 12/1972 | McDougal et al. | 109/84 |
| 4,179,979 | A | * | 12/1979 | Cook et al. | 89/36.02 |
| 4,602,385 | A | * | 7/1986 | Warren | 2/2.14 |
| 5,134,725 | A | * | 8/1992 | Yeshurun et al. | 2/2.5 |
| 5,361,678 | A | * | 11/1994 | Roopchand et al. | 89/36.02 |
| 5,738,925 | A | | 4/1998 | Chaput | |
| 5,972,819 | A | * | 10/1999 | Cohen | 501/127 |
| 6,112,635 | A | * | 9/2000 | Cohen | 89/36.02 |
| 6,203,908 | B1 | * | 3/2001 | Cohen | 428/397 |

FOREIGN PATENT DOCUMENTS

| | | |
|---|---|---|
| DE | 3940623 | 6/1991 |
| EP | 0699887 | 3/1996 |
| FR | 8401605 | 9/1985 |
| WO | PCT/US98/03128 | 8/1998 |

* cited by examiner

*Primary Examiner*—Charles T. Jordan
*Assistant Examiner*—Jordan M Lofdahl
(74) *Attorney, Agent, or Firm*—Fulbright & Jaworski L.L.P.

(57) ABSTRACT

The invention provides a composite armor plate (4) for absorbing and dissipating kinetic energy from high velocity, armor-piercing projectiles, as well as from soft-nosed projectiles, the plate comprising a single internal layer of high density ceramic pellets (6), characterized in that the pellets are arranged in a single layer of adjacent rows and columns, wherein a majority of each of the pellets (6') is in direct contact with at least four adjacent pellets (6") and each of the pellets are substantially cylindrical in shape with at least one convexly-curved end face, further characterized in that spaces formed between the adjacent cylindrical pellets are filled with a material (10) for preventing the flow of soft metal from impacting projectiles through the spaces, the pellets (6) and material (10) being bound and retained in plate form by a solidified material (8), wherein the solidified material (8) and the plate material are elastic.

4 Claims, 1 Drawing Sheet

COMPOSITE ARMOR PANEL

TECHNICAL FIELD

The present invention relates to a composite armor plate and a composite armor panel incorporating the same. More particularly, the invention relates to an armored panel providing lightweight ballistic protection which may be worn by the user, as well providing ballistic protection for protecting light and heavy mobile equipment and vehicles against high-speed armor-piercing projectiles or fragments, as well as from soft-nosed projectiles.

BACKGROUND ART

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminium; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed, e.g., in British Patents 1,081,464; 1,352,418; 2,272,272, and in U.S. Pat. No. 4,061,815 wherein the use of sintered refractory material, as well as the use of ceramic materials, are described.

Ceramic materials are nonmetallic, inorganic solids having a crystalline or glassy structure, and have many useful physical properties, including resistance to heat, abrasion and compression, high rigidity, low weight in comparison with steel, and outstanding chemical stabiity. Such properties have long drawn the attention of armor designers, and solid ceramic plates, in thicknesses ranging from 3 mm. for personal protection to 50 mm. for heavy military vehicles, are commercially available for such use.

Much research has been devoted to improving the low tensile and low flexible strength and poor fracture toughness of ceramic materials; however, these remain the major drawbacks to the use of ceramic plates and other large components which can crack and/or shatter in response to the shock of an incoming projectile.

Light-weight, flexible armored articles of clothing have also been used for many decades, for personal protection against fire-arm projectiles and projectile splinters. Examples of this type of armor are found in U.S. Pat. No. 4,090,005. Such clothing is certainly valuable against low-energy projectiles, such as those fired from a distance of several hundred meters, but fails to protect the wearer against high-velocity projectiles originating at closer range and especially does not protect against armor-piercing projectiles. If made to provide such protection, the weight and/or cost of such clothing discourages its use. A further known problem with such clothing is that even when it succeeds in stopping a projectile the user may suffer injury due to indentation of the vest into the body, caused by too small a body area being impacted and required to absorb the energy of a bullet.

A common problem with prior art ceramic armor concerns damage inflicted on the armor structure by a first projectile, whether stopped or penetrating. Such damage weakens the armor panel, and so allows penetration of a following projectile, impacting within a few centimeters of the first.

DISCLOSURE OF THE INVENTION

The present invention is therefore intended to obviate the disadvantages of prior art ceramic armor, and in a first embodiment to provide an armor panel which is effective against small-caliber fire-arm projectiles, yet is of light weight, i.e, having a weight of less than 45 kg/m$^2$, which is equivalent to about 9 lbs/ft$^2$, and low bulk.

In further embodiments of the present invention there is provided an armor panel which is effective against a full range of armor-piercing projectiles from 5.56 mm and even up to 30 mm, as well as from normal small-caliber fire-arm projectiles, yet is of light weight, i.e, having a weight of less than 185 kg/m$^2$, even for the heavier armor provided by the present invention for dealing with 25 and 30 mm projectiles.

A further object of the invention is to provide an armor panel which is particularly effective in arresting a plurality of armor-piercing projectiles impacting upon the same general area of the panel.

In PCT application PCT/IL98/00153, by the same inventor, there is described and claimed a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of adjacent rows, characterized in that the pellets have an $Al_2O_3$ content of at least 93% and a specific gravity of at least 2.5, the majority of the pellets each have at least one axis of at least 3 mm length and are bound by said solidified material in a single internal layer of adjacent rows, wherein a majority of each of said pellets is in direct contact with at least 4 adjacent pellets, and said solidified material and said plate are elastic.

In preferred embodiments of said invention there is provided a composite armor plate as defined above, wherein the majority of the pellets each have at least one axis in the range of about 6–19 mm, and are bound by said solidified material in a single internal layer of adjacent rows, wherein a majority of each of said pellets is in direct contact with at least 4 adjacent pellets, and the total weight of said plate does not exceed 45 kg/m$^2$.

In further preferred embodiments of said invention there is provided a composite armor plate as defined above, wherein the majority of said pellets each have at least one axis having a length in the range of from about 20 to 40 mm and the weight of said plate does not exceed 185 kg/m$^2$.

In especially preferred embodiments disclosed in said specification said pellets are of a regular geometric form, having at least one convexly curved surface segment.

While said specification includes within its scope geometrical forms such as hexagonal prisms and prisms of square cross section with convexly curved end faces, the most preferred embodiment disclosed therein is a pellet of cylindrical cross section with convexly curved end faces.

Said pellets and armor panels utilizing the same have been tested and found to be exceptionally effective in deforming and shattering an impacting high-velocity armor-piercing projectile and panels incorporating the same have even been found to stop 3 armor-piercing projectiles fired sequentially at a relatively small triangular area of a multi-layer panel, comprising an outer, impact-receiving panel of composite armor plate as hereinbefore defined, for deforming and shattering an impacting high velocity, armor-piercing projectile; and an inner layer adjacent to said outer panel, comprising a second panel of elastic material for absorbing the remaining kinetic energy from said fragments. However it has been found that when soft-nosed projectiles, such as lead bullets and/or projectiles having a soft metallic component are fired at such a panel, the soft metal flows through the interstices between adjacently arrayed cylindrical pellets and a thick inner layer of tough woven textile material, such as DYNEEMA® must be utilized to absorb the remaining kinetic energy from said flowing fragments.

As is known, the various tough woven textile materials used in composite armor, such as DYNEEMA® and FAMASTON®, which are both made of polyethylene fibers, and KEVLAR®, which is made of aramide fibers, are quite expensive and added thickness thereof adds considerable cost to a composite armor panel containing the same.

In order to obviate this problem there is now provided, according to the present invention, a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

In both French Publication 2 559 254 and U.S. Pat. No. 5,134,725 there are described composite armor plates for absorbing and dissipating kenetic energy from armor-piercing projectiles, having high density ceramic pellets arranged therein, however neither of said publications teach or suggest an arrangement wherein the spaces between said pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets.

In preferred embodiments of the present invention said space-filling material is selected from the group consisting of ceramic and glass.

In a first preferred embodiment of the present invention said material is in the form of a triangular insert having concave sides complimentary to the convex curvature of the sides of three adjacent cylindrical pellets.

In a second preferred embodiment of the present invention said material is integrally formed as part of a special interstices-filling pellet, said pellet being in the form of a six sided star with concave sides complimentary to the convex curvature of the sides of six adjacent cylindrical pellets.

In especially preferred embodiments of the present invention, each of a majority of said special pellets is in direct contact with six adjacent pellets.

The plate according to the present invention can be assembled in a manner similar to that described in PCT/IL98/00153, the relevant teachings of which are incorporated herein by reference, with the necessary modifications dictated by the need to include either triangular inserts in the interstices between 3 adjacent pellets, or to set up an array with a central special pellet flanked on each side by a single cylindrical pellet and bracketed on top and bottom by 2 cylindrical pellets, as can be better seen with reference to appended FIG. 2, wherein either of the above arrays are placed in a horizontal mold and said plate-forming, solidified material, in liquid form, is either poured or sprayed into the mold by methods known per se.

Said solidified material can be any suitable material which retains elasticity upon hardening at the thickness used, such as aluminum, epoxy, a thermoplastic polymer, or a thermoset plastic, thereby allowing curvature of the plate without cracking to match curved surfaces to be protected, including body surfaces, as well as elastic reaction of the plate to incoming projectiles to allow increased contact force between adjacent pellets at the point of impact.

In French Patent 2,711,782, there is described a steel panel reinforced with ceramic materials; however, due to the rigidity and lack of elasticity of the steel of said panel, said panel does not have the ability to deflect armor-piercing projectiles unless a thickness of about 8–9 mm of steel is used, which adds undesirable excessive weight to the panel.

It is further to be noted that the elasticity of the material used in preferred embodiments of the present invention serves, to a certain extent, to increase the probability that a projectile will simultaneously impact several pellets, thereby increasing the efficiency of the stopping power of the panel of the present invention.

In especially preferred embodiments of the invention, there is provided a multi-layered armor panel, comprising an outer, impact-receiving panel of composite armor plate as hereinbefore defined, for deforming and shattering an impacting high velocity, armor-piercing projectile; as well as impeding the flow of soft projectile material such as lead between the cylindrical pellets of the plate and an inner layer adjacent to said outer panel, comprising a second panel of tough woven textile material for causing an asymmetric deformation of the remaining fragments of said projectile and for absorbing the remaining kinetic energy from said fragments.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention in which the hard ceramic pellets are in direct contact with adjacent pellets.

McDougal, et al. U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive.

A composite armor plate as described in the McDougal, et al. patent is difficult to manufacture because the ceramic spheres may be damaged by thermal shock arising from molten metal contact. The ceramic spheres are also sometimes displaced during casting of molten metal into interstices between the spheres.

In order to mimimize such displacement, Huet U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that McDougal suggests and teaches an array of ceramic balls disposed in contacting pyrimidal relationship, which arrangement also substantially increases the overall weight of the armored panel and decreases the stopping power thereof, due to a billiard-like effect upon impact.

In U.S. Pat. Nos. 3,523,057 and 5,134,725 there are described further armored panels incorporating ceramic balls; however, said panels are flexible and it has been found that the flexibility of said panels substantially reduces their stopping strength upon impact, since the force of impact itself causes a flexing of said panels and a reduction of the supporting effect of adjacent ceramic balls on the impacted ceramic ball. Furthermore, it will be noted that the teachings of U.S. Pat. No. 5,134,725 is limited to an armor plate having a plurality of constituent bodies of glass or ceramic material which are arranged in at least two superimposed layers, which arrangement is similar to that seen in McDougal (U.S. Pat. No. 3,705,558). In addition, reference to FIGS. 3 and 4 of said patent show that pellets of a first layer do not contact pellets of the same layer and are only in contact with pellets of an adjacent layer.

As will be realized, none of said prior art patents teaches or suggests the surprising and unexpected stopping power of a single layer of ceramic pellets in direct contact with each other and certainly do not teach or suggest the combined use of cylindrical pellets and interstices-filling material which, as will be shown hereinafter, successfully prevents penetration of armor-piercing projectiles, as well as the penetration of fragments from soft-nosed projectiles when used in conjunction with a relatively narrow layer of tough woven textile material of less than 10 mm thickness.

Thus, it has been found that the novel armor of the present invention traps incoming projectiles between several very hard ceramic pellets which are held in a single layer in rigid mutual abutting relationship. The relatively moderate size of the pellets ensures that the damage caused by a first projectile is localized and does not spread to adjoining areas, as in the case of ceramic pellets.

A major advantage of the novel approach provided by the present invention is that it enables the fabrication of different panels adapted to deal with different challenges, wherein e.g. smaller pellets can be used for personal armor and for meeting the challenge of 5.56, 7.62 and 9 mm projectiles, while larger pellets can be used to deal with foreseen challenges presented by 14.5 mm, 25 mm and even 30 mm armor piercing projectiles.

Thus it was found that cylindrical pellets having a diameter of 12.7 mm and a height of 12.7 mm, in combination with the interdispersion therein of the special interstices-filling star-shaped pellet described herein provided with a backing of only 8 mm of DYNEEMA®, were more than adequate to deal with both armor-piercing and soft-nosed component projectiles between 5.56 and 7.62 mm, when arranged in a panel according to the present invention.

An incoming projectile may contact the pellet array in one of three ways:

1. Center contact. The impact allows the full volume of the pellet to participate in stopping the projectile, which cannot penetrate without pulverising the whole pellet, an energy-intensive task.
2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact The projectile is jammed, usually between the flanks of three pellets, all of which participate in projectile arrest. The high side forces applied to the pellets are resisted by the pellets adjacent thereto as held by the solid matrix, and penetration is prevented.

As will be realized, when preparing the composite armor plate of the present invention, said pellets and the triangular inserts or special pellets, whichever used, do not necessarily have to be completely covered on both sides by said solidified material, and they can touch or even bulge from the outer surfaces of the formed panel.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DESCRIPTION OF THE PREFERRED EMBODIMENTS

Figure 1:
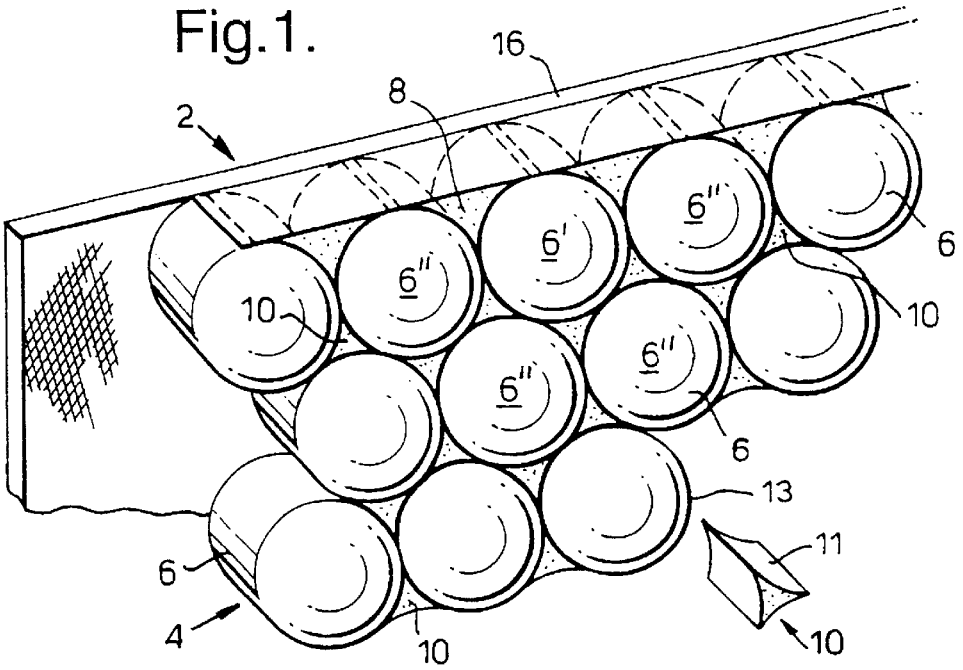
FIG. 1 is a perspective view of a small section of a first preferred embodiment of an armor panel according to the invention.

There is seen in FIG. 1 a composite armor plate 4 for absorbing and dissipating kinetic energy from high velocity, armor-piercing projectiles, as well as from soft-nosed projectiles, said plate comprising a single internal layer of high density ceramic pellets 6, characterized in that said pellets are arranged in a single layer of adjacent rows and columns, wherein a majority of each of said pellets 6' is in direct contact with at least four adjacent pellets 6" and each of said pellets are substantially cylindrical in shape with at least one convexly-curved end face.

As will be noted, in FIG. 1 spaces (not shown) formed between said adjacent cylindrical pellets 6 are filled with triangular inserts 10 having concave sides 11 complimentary to the convex curvature 13 of the sides of three adjacent cylindrical pellets.

Figure 2:
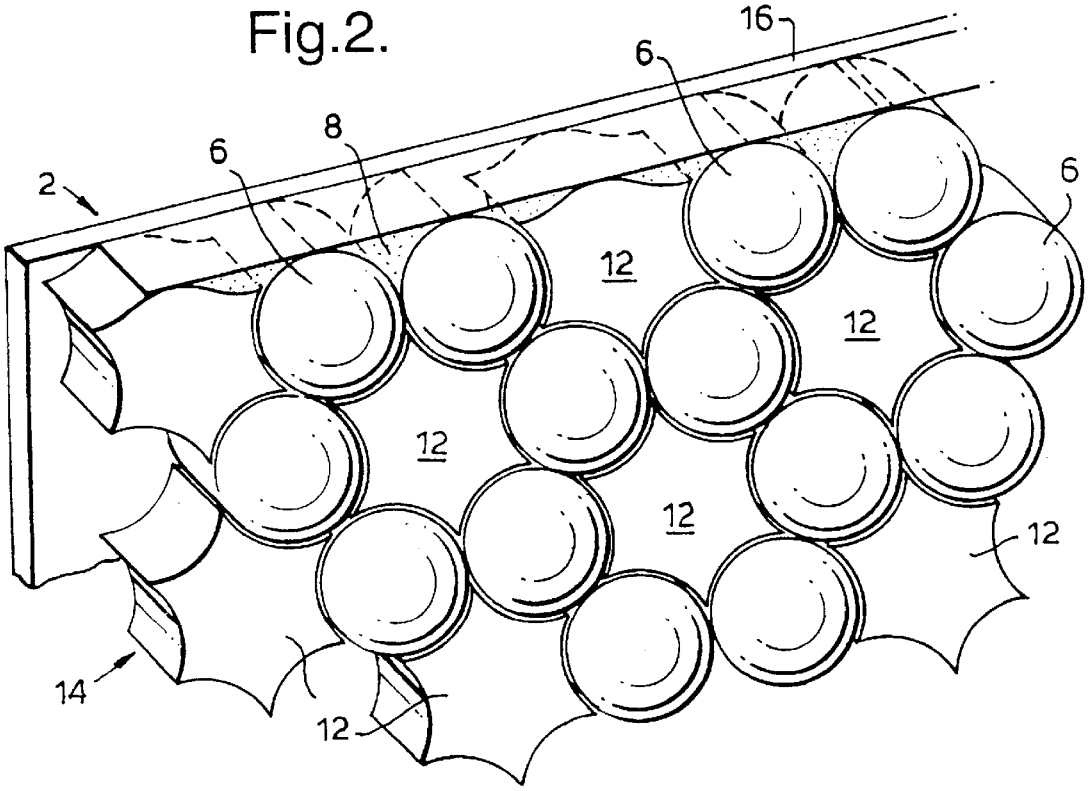
FIG. 2 is a perspective view of a small section of a second preferred embodiment of an armor panel according to the invention

Referring to FIG. 2, there is seen a further preferred embodiment of the present invention, wherein there is provided an armor plate 14 which includes a plurality of special star-shaped interstices-filling pellets 12, each of said special pellets 12 being in contact with six surrounding adjacent cylindrical pellets 6. As seen, said entire array is bound in a single layer of a plurality of adjacent rows and columns by solidified epoxy 8 and said plate 14 is further provided with an inner backing layer 16 made of DYNEEMA® or of similar material to form a multi-layered armored panel 2 as shown.

In operation, inner panel 16 causes asymmetric deformation of the remaining fragments of the projectile and absorbs remaining kinetic energy from these fragments by deflecting and compressing them within the confines of said inner The nature of the solidified material 8 is selected in accordance with the weight, performance and cost considerations applicable to the intended use of the armor.

Armor for land and sea vehicles is suitably made using a metal casting alloy containing at least 80% aluminum. A suitable alloy is Aluminum Association No. 535.0, which combines a high tensile strength of 35,000 kg/in$^2$, with excellent ductility, having 9% elongation. Further suitable alloys are of the type containing 5% silicon B443.0. These alloys are easy to cast in thin sections; their poor machinability is of little concern in the application of the present invention. An epoxy or other plastic or polymeric material, advantageously fiber-reinforced, is also suitable.

Pellets 6 have an alumina ($Al_2O_3$) content of at least 93%, and have a hardness of 9 on the Mohs scale. Regarding size, the majority of pellets have a major axis in the range of from about 340 mm, the preferred range being from 6–19 mm for personal armor and lightweight vehicles and the preferred range being from 20–30 mm for protecting light and heavy mobile equipment and vehicles against high caliber armor-piercing projectiles.

In operation, the panel 2 acts to stop an incoming projectile in one of three modes: centre contact, flank contact, and valley contact, as described above.

Tables 1 and 2 are reproductions of test reports relating to epoxy-bound multi-layer panels described above with reference to FIG. 2, having a plurality of pellets substantially cylindrical in shape with at least one convexly curved end face, the diameter of each of said pellets being about 12.7 mm and the height of said pellets, including said convex end face, being about 12.7 mm, said pellets being formed in the array shown in FIG. 2, which includes star-shaped interstices-filling pellets in contact with six surrounding adjacent cylindrical pellets and said entire array being bound in a single layer of a plurality of adjacent rows and columns by solidified epoxy, said plate having an inner backing layer 8 mm thick made of DYNEEMA®). Each of the panels had dimensions of 40×40 cm.

The first panel was impacted by a series of eight 7.62 mm armor-piercing projectiles fired at 0 elevation and at a distance of 15 m from the target.

None of the eight projectiles penetrated the panel.

The second panel was impaced by a series of nine soft-nosed component 7.62 mm projectiles, also fired at 0 elevation and at a distance of 15 m from the target.

None of the the nine projectiles penetrated the panel.

TABLE 1

BALLISTIC TEST REPORT

FMS
ENTERPRISES MIGUN LTD.

DATE: 03/29/98
CUSTOMER: MOFET-EZION.
SIZE: 400 × 400
TEMP.: 23.0 (deg. C.)
RANGE: 15.0 mtr.
SPEC.: NIJ-STD-0101.03
PANEL CONDITIONED: WET, IN WATER FOR: 0 hours TEST NO.: 5639
CODE:
PANEL WEIGHT sq. mtr: 0.000 kg.
HUMIDITY: 57%
LEVEL: 4

RESULTS TABLE

| SHOT NO. | GUN MODEL | BARR. LENG. inch | CALIBER mm | BULLET TYPE | BULLET WEIGHT grain | SHOT ANGLE deg. | TRAUMA DEPTH inch | TRAUMA WIDTH inch | VEL. mtr/sec. | VEL. ft./sec. | PENETRAT Y/N | INCL. V-50 +/− |
|---|---|---|---|---|---|---|---|---|---|---|---|---|
| 1 | BARREL | 24.00 | 7.620 | A.P-M2 | 166.0 | 0 | 0 | 0 | 887 | 2910 | N | + |
| 2 | BARREL | 24.00 | 7.620 | A.P-M2 | 166.0 | 0 | 0 | 0 | 882 | 2894 | N | + |
| 3 | BARREL | 24.00 | 7.620 | AP-IB32 | 171.0 | 0 | 0 | 0 | 875 | 2870 | N | + |
| 4 | BARREL | 24.00 | 7.620 | AP-IB32 | 171.0 | 0 | 0 | 0 | 879 | 2885 | N | + |
| 5 | BARREL | 20.00 | 7.620 | AP | 120.0 | 0 | 0 | 0 | 757 | 2485 | N | + |
| 6 | BARREL | 20.00 | 7.620 | AP | 120.0 | 0 | 0 | 0 | 766 | 2512 | N | + |
| 7 | BARREL | 24.00 | 7.620 | AP M61 | 166.0 | 0 | 0 | 0 | 873 | 2865 | N | + |
| 8 | BARREL | 24.00 | 7.620 | AP M61 | 166.0 | 0 | 0 | 0 | 871 | 2859 | N | + |
| AVERAGE OF NOT PENETRAT SHOTS | | | | | | | 0.0 | 0.0 | 848 | 2785 | | 0.0 |

REMARKS:
BULLET NO. 1, 2. 30-06 7.62 × 63 NO. 3, 4. 7.62 × 54 DRAGANOV.
NO. 5, 6. 7.62 × 39 AK-47 CHINA. NO. 7, 8. 7.62 × 51

GUNNER NAME: FUCHS YUVAL

INSPECTOR NAME: ELAN

Signature of gunner
FIBROTEC
F.M.S. (1986) LTD.
BALLISTIC LABORATORY
JUVAL FUCHS Signature of inspector

TABLE 2

BALLISTIC TEST REPORT

FMS
ENTERPRISES MIGUN LTD.

DATE: 03/29/98
CUSTOMER: MOFET-EZION.
SIZE: 400 × 400
TEMP.: 23.0 (deg. C.)
RANGE: 15.0 mtr.
PANEL CONDITIONED: WET, IN WATER FOR: 0 hours TEST NO.: 5649
CODE:
PANEL WEIGHT sq. mtr: 0.000 kg.
HUMIDITY: 57%

RESULTS TABLE

| SHOT NO. | GUN MODEL | BARR. LENG. inch | CALIBER mm | BULLET TYPE | BULLET WEIGHT grain | SHOT ANGLE deg. | TRAUMA DEPTH inch | TRAUMA WIDTH inch | VEL. mtr/sec. | VEL. ft./sec. | PENETRAT Y/N | INCL. V-50 +/− |
|---|---|---|---|---|---|---|---|---|---|---|---|---|
| 1 | BARREL | 24.00 | 7.620 | F.M.J. | 150.0 | 0 | 0 | 0 | 847 | 2779 | N | + |
| 2 | BARREL | 24.00 | 7.620 | F.M.J. | 150.0 | 0 | 0 | 0 | 852 | 2795 | N | + |
| 3 | BARREL | 24.00 | 7.620 | F.M.J. | 150.0 | 0 | 0 | 0 | 846 | 2776 | N | + |
| 4 | BARREL | 20.00 | 5.560 | M-193. | 55.0 | 0 | 0 | 0 | 1004 | 3294 | N | + |
| 5 | BARREL | 20.00 | 5.560 | M-193. | 55.0 | 0 | 0 | 0 | 1017 | 3337 | N | + |
| 6 | BARREL | 20.00 | 5.560 | M-193. | 55.0 | 0 | 0 | 0 | 1022 | 3353 | N | + |

TABLE 2-continued

| | | | | | | | | | | | | |
|---|---|---|---|---|---|---|---|---|---|---|---|---|
| 7 | BARREL | 20.00 | 7.620 | M-43 | 123.0 | 0 | 0 | 0 | 749 | 2457 | N | + |
| 8 | BARREL | 20.00 | 7.620 | M-43 | 123.0 | 0 | 0 | 0 | 756 | 2480 | N | + |
| 9 | BARREL | 20.00 | 7.620 | M-43 | 123.0 | 0 | 0 | 0 | 760 | 2493 | N | + |
| AVERAGE OF NOT PENETRAT SHOTS | | | | | | | 0.0 | 0.0 | 872 | 2862 | | 0.0 |

REMARKS:
BULLET NO. 1–3 NATO BALL USA NIJ STD. 0101.03 LEVEL 3.
BULLET NO. 4–9 I.D.F. STD.

GUNNER NAME: FUCHS YUVAL

Signature of gunner
FIBROTEC
F.M.S. (1986) LTD.
BALLISTIC LABORATORY
JUVAL FUCHS

INSPECTOR NAME: ELAN

Signature of inspector

Tables 3 and 4 are reproductions of comparative test reports relating to epoxy-bound multi-layer panels, having a plurality of pellets substantially cylindrical in shape with at least one convexly curved end face, the diameter of each of said pellets being about 12.7 mm and the height of said pellets, including said convex end face, being about 12.7 mm, said pellets being formed in an array of adjacent cylindrical pellets, as described and claimed in EP/IL98/00153, without any triangular insert or star-shaped interstices-filling pellets inserted therein. Said entire array is also bound in a single layer of a plurality of adjacent rows and columns by solidified epoxy, and each of said plates has an inner backing layer 8 mm thick made of DYNEEMA®. Each of the panels had dimensions of 25×30 cm.

The panel referred to in Table 3 hereinafter was impacted by a series of four 7.62 mm armor-piercing projectiles fired at 0 elevation and at a distance of 10 m from the target.

None of the four projectiles penetrated the panel.

The panel referred to in Table 4 was impacted by a series of three soft metal component 5.56 mm projectiles and three soft metal component 7.62 mm projectiles, all fired at 0 elevation and at a distance of 10 m from the target.

All six of the projectiles produced fragments which penetrated the panel.

TABLE 3

BALLISTIC TEST REPORT

FMS
ENTERPRISES MIGUN LTD.

DATE: 10/09/96
TEST NO.: 4294
CUSTOMER: IDF-MOFET-FMS
CODE:
SIZE: 300 × 250
PANEL WEIGHT sq. mtr: 31.000 kg.
TEMP.: 23.0 (deg. C.)
HUMIDITY: 55%
RANGE: 10.0 mtr.
SPEC.: IDF-STD
PANEL CONDITIONED: WET, IN WATER FOR: 0 hours REMARKS:
26 KG/SQ. M.-MOFET + 5 KG/SQ. M.-Ariston + 14 LAIERS ARAMID STYLE 802
102 mm. CLAY BACKING.

RESULTS TABLE

| SHOT NO. | GUN MODEL | BARR. LENG. inch | CALIBER mm | BULLET TYPE | BULLET WEIGHT grain | SHOT ANGLE deg. | TRAUMA DEPTH mm | TRAUMA WIDTH mm | VEL. mtr/sec. | VEL. ft./sec. | PENETRAT Y/N | INCL. V-50 +/− |
|---|---|---|---|---|---|---|---|---|---|---|---|---|
| 1 | AK-47 | 20.00 | 7.620 | API-BZ | 120.5 | 0 | 20 | 0 | 716 | 2349 | N | + |
| 2 | AK-47 | 20.00 | 7.620 | API-BZ | 120.5 | 0 | 22 | 0 | 740 | 2428 | N | + |

TABLE 3-continued

| | | | | | | | | | | | | |
|---|---|---|---|---|---|---|---|---|---|---|---|---|
| 3 | AK-47 | 20.00 | 7.620 | API-BZ | 120.5 | 0 | 25 | 0 | 768 | 2520 | N | + |
| 4 | AK-47 | 20.00 | 7.620 | API-BZ | 120.5 | 0 | 23 | 0 | 744 | 2441 | N | + |
| AVERAGE OF NOT PENETRAT SHOTS | | | | | | | 22.5 | 0.0 | 742 | 2434 | | 0.0 |

REMARKS:
BULLET MADE IN RUSIA.
BETWEEN BULLET 4 TO BULLET 3 25 mm. BULLET 4 TO 2 40 mm.
GUNNER NAME: Y. FUCHS. INSPECTOR NAME: ELAN

Signature of gunner
FIBROTEC
F.M.S. (1986) LTD.
BALLISTIC LABORATORY
JUVAL FUCHS Signature of inspector

TABLE 4

BALLISTIC TEST REPORT

FMS
ENTERPRISES MIGUN LTD.
DATE: 10/09/96 TEST NO.: 4291
CUSTOMER: MOFET-EZION. CODE:
SIZE: 300 × 250 PANEL WEIGHT sq. mtr: 0.000 kg.
TEMP.: 23.0 (deg. C.) HUMIDITY: 57%
RANGE: 10.0 mtr.
PANEL CONDITIONED: WET, IN WATER FOR: 0 hours

RESULTS TABLE

| SHOT NO. | GUN MODEL | BARR. LENG. inch | CALIBER mm | BULLET TYPE | BULLET WEIGHT grain | SHOT ANGLE deg. | TRAUMA DEPTH inch | TRAUMA WIDTH inch | VEL. mtr/sec. | VEL. ft./sec. | PENETRAT Y/N | INCL. V-50 +/− |
|---|---|---|---|---|---|---|---|---|---|---|---|---|
| 1 | BARREL | 20.00 | 5.560 | M-193 | 55.0 | 0 | 0 | 0 | 979 | 3212 | N | + |
| 2 | BARREL | 20.00 | 5.560 | M-193 | 55.0 | 0 | 0 | 0 | 1008 | 3307 | Y | + |
| 3 | BARREL | 20.00 | 5.560 | M-193 | 55.0 | 0 | 0 | 0 | 995 | 3264 | Y | + |
| 4 | BARREL | 24.00 | 7.620 | F.M.J. | 150.0 | 0 | 0 | 0 | 854 | 2802 | Y | + |
| 5 | BARREL | 24.00 | 7.620 | F.M.J. | 150.0 | 0 | 0 | 0 | 841 | 2759 | Y | + |
| 6 | BARREL | 24.00 | 7.620 | F.M.J. | 150.0 | 0 | 0 | 0 | 830 | 2723 | Y | + |
| AVERAGE OF NOT PENETRAT SHOTS | | | | | | | 0.0 | 0.0 | 979 | 3212 | | 0.0 |

REMARKS:
ACCORDING TO THIS CRITERIA THE TEST HAS FAILED.
GUNNER NAME: FUCHS YUVAL INSPECTOR NAME: ELAN

Signature of gunner
FIBROTEC
F.M.S. (1986) LTD.
BALLISTIC LABORATORY
JUVAL FUCHS Signature of inspector As will be seen, while the composite armor panel described and claimed in PCT/IL98/00153 is more than adequate to prevent penetration by armor-piercing projectiles when also provided with an inner layer of DYNEEMA® of 8 mm thickness, said thickness is not sufficient to prevent the penetration of soft projectile material fragments from standard rounds. Therefore, the present invention provides a major improvement for composite armor panels having an array of high density ceramic pellets which are directly bound and retained in plate form and in direct contact with at least four adjacent pellets, when said pellets are substantially cylindrical in shape.

As will be realized, the above problem does not exist with regard to other geometric forms encompassed and claimed in PCT/IL98/00153, e.g. geometrical forms such as hexagonal prisms and prisms of square cross section with convexly curved end faces, since in these embodiments all of the sides of the pellets are in direct contact with adjacent pellets without any substantial space therebetween. However, since such configurations are more difficult to manufacture, the present invention provides a solution for pellets which are substantially cylindrical in shape and which are more readily manufactured, although presenting a problem of penetration of soft metallic projectile material in the triangular interstices between each three adjacent pellets when a backing of less than 12 mm of DYNEEMA® is not provided therewith.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

2. A composite armor plate according to claim 1, wherein said material is selected from the group consisting of ceramic and glass.

3. A multi-layered armor panel, comprising:

an outer, impact-receiving panel of composite armor plate according to claim 1, for deforming and shattering an impacting high velocity, armor-piercing projectile, as well as for impeding the penetration of soft projectile material; and an inner layer adjacent to said outer panel, comprising a second panel of tough woven textile material for causing an asymmetric deformation of the remaining fragments of said projectile and for absorbing the remaining kinetic energy from said fragments.

4. A multi-layered armor panel according to claim 1, wherein said inner layer is less than 10 mm thick.

* * * * *